US005324952A

United States Patent [19]

Cummings

[11] Patent Number: 5,324,952

[45] Date of Patent: Jun. 28, 1994

[54] RADIATION SHIELDING FOR SPACECRAFT COMPONENTS

[75] Inventor: Brent C. Cummings, Lyons, Colo.

[73] Assignee: Ball Corporation, Muncie, Ind.

[21] Appl. No.: 911,761

[22] Filed: Jul. 10, 1992

[51] Int. Cl.[5] ..... G21F 1/12

[52] U.S. Cl. ..... 250/515.1; 250/518.1

[58] Field of Search ..... 250/515.1, 518.1, 519.1

[56] References Cited

U.S. PATENT DOCUMENTS

| | | | |
|---|---|---|---|
| 3,148,280 | 9/1964 | Kleber et al. | 250/518.1 |
| 3,261,800 | 7/1966 | Collins | 250/518.1 |
| 4,599,680 | 7/1986 | Gibson et al. | 361/386 |
| 4,751,021 | 6/1988 | Mollon | 250/518.1 |
| 4,833,334 | 5/1989 | Valey et al. | 250/515.1 |

OTHER PUBLICATIONS

Townsend et al., "Human Exposure to Large Solar Particle Events in Space", *Adv. Space Res.*, vol. 12. No. 2-3 pp. (2)339-(2)348, 1992.

Jordan et al., "Effective Radiation Reduction in Space Station and Missions Beyond the Magnetosphere", *Adv. Space Res.*, vol. 9, No. 10, pp. (10)261-(10)274, 1989.

*Primary Examiner*—Bruce C. Anderson

*Attorney, Agent, or Firm*—Gilbert E. Alberding

[57] ABSTRACT

An apparatus (10) for shielding a spacecraft component (18) against space environment radiation is provided. The apparatus comprises a first layer (12) to provide primary radiation attenuation and a second layer (16) to provide primary and secondary radiation attenuation. The apparatus (10) reduces primary and secondary radiation incidence on the component (18) relative to prior art, single layer radiation shields.

13 Claims, 3 Drawing Sheets

RADIATION SHIELDING FOR SPACECRAFT COMPONENTS

FIELD OF THE INVENTION

The present invention relates generally to radiation shielding and, in particular, to an apparatus for shielding a spacecraft component against space environment radiation. The invention is particularly useful in shielding devices which are sensitive to nonionizing radiation damage, such as optical components including charge-coupled devices.

BACKGROUND OF THE INVENTION

Components on orbiting spacecraft may be exposed to potentially damaging space environment radiation from a number of sources, including solar particle events, trapped proton radiation, cosmic rays and secondary radiation generated due to interaction of incident primary radiation with spacecraft borne materials. A primary source of such radiation is solar particle events such as solar flares which can result in significant proton fluence at orbital altitudes. Particularly if unabated, this proton fluence can have a harmful effect on spacecraft components such as semi-conductor devices due to various nuclear and atomic processes. In particular, solar proton fluence and associated secondary radiation can damage and impair the operation of optical systems such as imaging instruments which incorporate charge-coupled devices. It is therefore desirable to shield spacecraft components against such space environment radiation.

The particular materials and amounts of materials which can be used in shielding spacecraft components are limited by practical considerations. A principal design consideration is mass limitation. As is well-known, the total mass of a spacecraft affects the propulsion requirements for inserting the spacecraft into orbit and maneuvering. It is thus desirable to minimize spacecraft mass, including shielding components, in order to reduce propellant requirements, extend mission duration, and/or increase payload. In this regard, it is customary to compare shielding materials on a weight per unit (e.g., $gm/cm^2$) basis. Other considerations include ease of construction and the suitability of a particular material for use in a space environment. For example, shielding materials typically must be easily machinable, have low outgassing properties, and have correct thermal properties, e.g., a low coefficient of thermal expansion.

Heretofore, shields have generally been designed to reduce incident primary radiation levels and associated ionization damage. Accordingly, spacecraft component shielding has commonly been constructed from either aluminum or tantalum, each of which has primary proton radiation attenuation characteristics which are fairly well-known. Thus, to achieve a desired level of primary proton radiation attenuation, designers have provided an aluminum or tantalum shield of appropriate thickness within mass, dimensional, and other constraints. In this regard, the shield thickness has ordinarily been selected to attenuate primary radiation to a level thought sufficient to ensure device performance over the mission duration. Aluminum has been preferred for many applications because it is readily available and lightweight. Tantalum, which is a relatively dense material, has generally been used where the shielding has been subject to volumetric constraints.

SUMMARY OF THE INVENTION

Accordingly, objectives of the present invention include the following.

The provision of an improved apparatus for shielding spacecraft components against space environment radiation.

The provision of an apparatus for shielding spacecraft components against primary radiation from an external source and secondary radiation generated due to interaction of the primary radiation with shielding materials.

The provision of an apparatus for shielding spacecraft components against primary proton radiation and secondary neutron radiation wherein increased levels of radiation attenuation can be achieved for a given mass of shielding material.

The provision of an apparatus for shielding spacecraft components against space environment radiation having layers of different shielding materials, wherein the ordering of the layers with respect to incident radiation is selected to provide desired proton and/or neutron radiation attenuation characteristics.

The provision of an apparatus for shielding a spacecraft component against space environment radiation having at least a first proton blocking layer and a second neutron blocking layer.

The provision of an improved radiation shield for shielding spacecraft components which are sensitive to lo nonionizing radiation damage.

Additional objectives and corresponding advantages of the present invention will be apparent to those skilled in the art.

It has been determined that secondary radiation due to interaction of primary radiation with spacecraft borne materials can have a significant deleterious effect on certain spacecraft components, particularly components which are sensitive to nonionizing radiation damage. For example, charge coupled device performance is primarily limited by radiation displacement damage effects such as charge transfer inefficiency, increased dark current, and dark current spikes which correlate more closely with nonionizing radiation dose than with ionizing radiation dose. Secondary neutron radiation emerging from known solar flare shielding, particularly moderate to thick shielding, can produce such nonionizing radiation damage effects. Accordingly, known shielding design techniques, wherein nonionizing radiation effects and secondary radiation effects are commonly not considered, may be inadequate for many applications.

It has also been recognized that, for a radiation shield having layers of different shielding materials, the ordering of the layers with respect to incident space radiation affects the radiation attenuation characteristics of the shield. That is, radiation penetration through a layered shield and secondary radiation emission therefrom depends not only on the thickness of the layers but also on the ordering of the layers. This is believed to be due the fact that different layers in such a shield are exposed to different radiation fields. In particular, the outside layer of such a shield, i.e., the layer first met by incident radiation, is exposed mainly to primary radiation from a radiation source. However, an inside layer of such a shield, i.e., a layer positioned behind the outside layer, is exposed not only to the primary radiation which penetrates the outside layer but also to secondary radiation due to interaction of the primary radiation with the outside layer. The present invention advantageously utilizes the noted shielding principles to provide an improved apparatus for shielding spacecraft components against space environment radiation wherein the radiation attenuation characteristics of each layer of a multi-layer shield can be matched to the local radiation field.

In the following description, particular shielding materials will be described with respect to their ability to attenuate certain types of radiation. In this regard, the term "primary radiation attenuation efficiency", as used herein, refers to the ratio of primary radiation absorbed by a shielding material to the total primary radiation incident thereon for a unit thickness (in $gm/cm^2$) of the shielding material. Similarly, the term "proton attenuation efficiency" refers to the ratio of protons absorbed by a shielding material to the total number of protons incident thereon for a unit thickness of the material. In addition, the term "secondary radiation attenuation efficiency" refers to the ratio of secondary radiation absorbed by a shielding material to the total secondary radiation incident thereon for a unit thickness of the shielding material. The term "neutron attenuation efficiency" refers to the ratio of the number of neutrons absorbed by a shielding material to the total number of neutrons incident thereon for a unit thickness of the shielding material.

According to one aspect of the present invention, an apparatus for shielding a spacecraft component against space environment radiation from a radiation source is provided. The apparatus comprises a first layer constructed from a first material to provide primary radiation attenuation, wherein secondary radiation emerges from the first layer due to interaction of primary radiation with the first layer. The apparatus further includes a second layer to provide secondary radiation attenuation. The first layer is positioned between the radiation source and the spacecraft component and the second layer is positioned between the first layer and the spacecraft component. The first and second layers can be abutting or separated. In this regard, the first layer may comprise a portion of a spacecraft wall.

The apparatus may be employed to shield spacecraft optical components including charge-coupled devices against primary and secondary radiation. In this regard, the first layer may have a greater primary radiation attenuation efficiency than the second layer whereas the second layer may have a greater secondary radiation attenuation efficiency. The first layer preferably has a primary radiation attenuation efficiency for primary radiation having an energy between about $10^{-2}$ MeV and $10^{0}$ MeV at least equal to that of aluminum and can comprise a material including a chemical element having an atomic number less than about 14. The second layer preferably has a secondary radiation attenuation efficiency at least equal to boron-nitride and can comprise a material including a chemical element selected from the group consisting essentially of beryllium, boron, and carbon.

According to another aspect of the present invention, an apparatus for shielding a spacecraft component against proton radiation due to solar particle events is provided. The apparatus comprises a first, proton blocking layer constructed from a first material to provide a desired level of proton radiation attenuation wherein neutron radiation is generated due to interaction of the proton radiation with the first layer, and a second, proton and neutron blocking layer to provide a desired level of proton and neutron radiation attenuation. The first layer is positioned to shield the component against proton radiation from the radiation source and the second layer is positioned between the first layer and the component. For example, the first layer can comprise aluminum and the second layer can comprise boron-nitride. The apparatus may be employed to shield an optical component including a charge-coupled device against space environment radiation.

BRIEF DESCRIPTION OF THE DRAWINGS

For a more complete understanding of the present invention and for further advantages thereof, reference is now made to the following Detailed Description taken in conjunction with the accompanying drawings, in which.

DETAILED DESCRIPTION OF INVENTION

Figure 1:
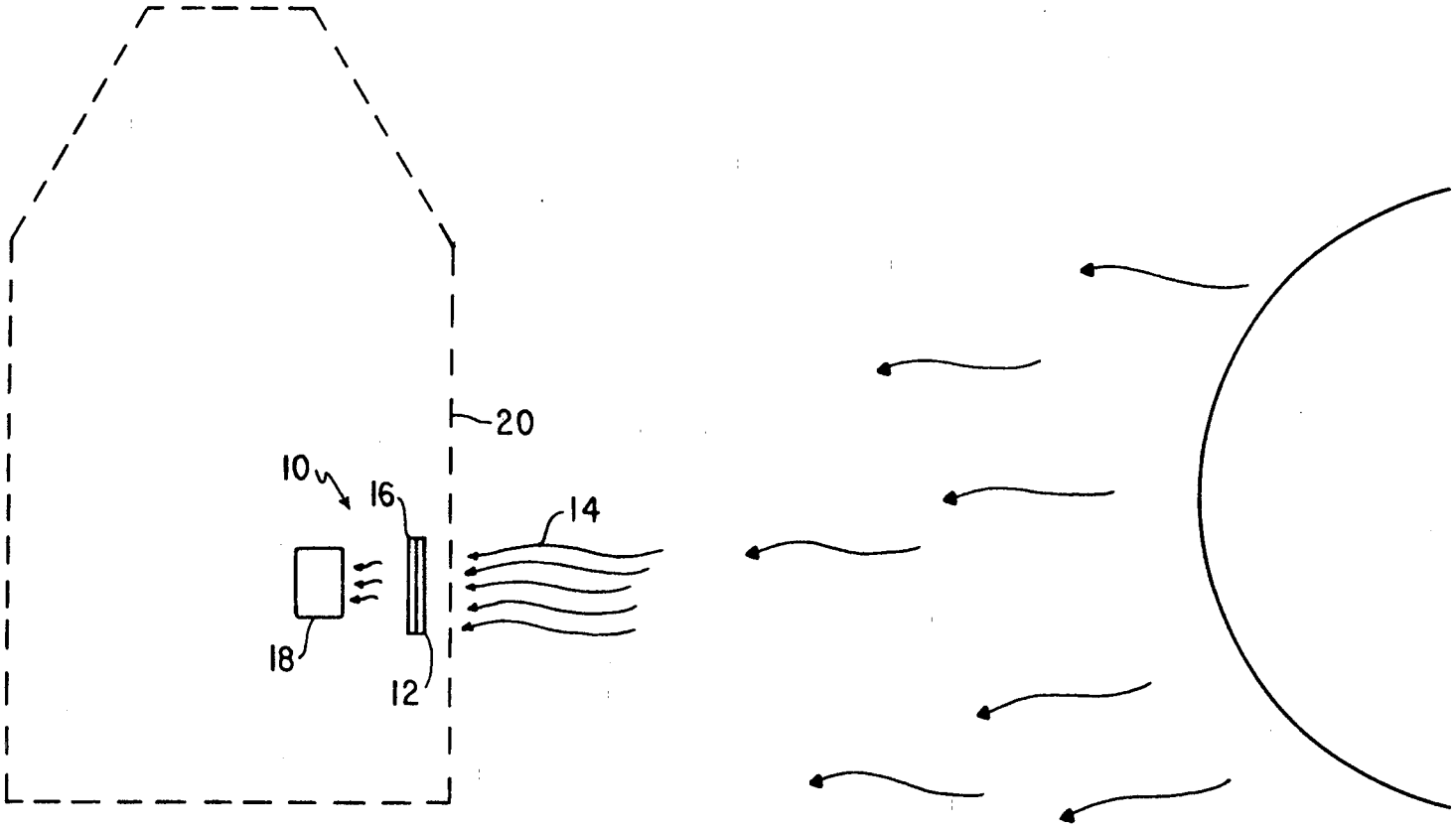
FIG. 1 is a schematic representation of a spacecraft incorporating a shielding apparatus embodying the present invention.

Referring to FIG. 1, a spacecraft 20 is illustrated which incorporates shielding apparatus 10 in accordance with the present invention. The apparatus 10 comprises a first layer 12 to attenuate primary radiation, generally indicated by arrows 14, and a second layer 16 to further attenuate primary radiation 14 and to attenuate secondary radiation, including secondary proton and neutron radiation, generated due to interaction of the incident radiation 14 with the first layer 12. Although the apparatus 10 is described herein with respect to an embodiment wherein the shielding is employed to shield an optical component 18 comprising a charge-coupled device on board a spacecraft 20 against proton radiation due to a solar particle event, it will be appreciated by those skilled in the art that shields constructed in accordance with the present invention can be utilized in other space radiation shielding applications. In addition, although the layers 12 and 16 are shown in an abutting relationship and positioned inside of spacecraft 20, the layers 12 and 16 may be separated and various configurations are possible. For example, the first layer may conveniently comprise a portion of a spacecraft wall or skin. Moreover, shields having more than two layers may be constructed in accordance with the present invention. Arrows 22 indicate the resulting, attenuated radiation incident on component 18.

The first layer 12, which is the first layer met by the primary radiation 14, provides a desired level of primary radiation attenuation. The first layer 12 is positioned between the radiation source and the component 18. In the illustrated embodiment, wherein the primary radiation 14 comprises proton fluence due to a solar particle event, the first layer can be selected to provide a desired level of proton attenuation. The desired level of proton attenuation will vary depending on many factors. For example, a relatively high level of attenuation may be desired for shielding particularly sensitive electronic components. In addition, a high level of attenuation may be desired for missions of long duration, deep space missions, and other missions where large exposures to radiation are expected.

Other factors which may affect the desired level of attenuation for shielding used on Earth orbiting satellites include the altitude and inclination of the satellite orbit and the proportion of mission time during which the satellite will be shaded from solar radiation by the Earth. The desired level of proton radiation attenuation of the first layer will also be affected by the unpredictability of solar particle activity, the level of proton attenuation contributed by the second layer 16, and mass limitation considerations. It will therefore be appreciated that the level of proton radiation attenuation provided by the first layer 12 can vary broadly in accordance with the present invention. In practice, the proton radiation attenuation characteristics of the first layer can be determined with the aid of the specially adapted BRYNTRN software described below.

The second layer 16, which is positioned between the first layer 16 and the component 18, provides a desired level of secondary radiation attenuation in addition to enhancing primary radiation attenuation. The second layer 16 is exposed to primary radiation 14 which penetrates the first layer 12 and secondary radiation generated due to interaction between the first layer 12 and the primary radiation 14. Thus, in the illustrated embodiment, the radiation attenuation characteristics of the second layer 16 can be selected with reference to the local radiation field which will include primary protons, secondary neutrons and secondary protons. The desired level of radiation attenuation for the second layer 16 will depend on many of the factors listed above in connection with the first layer 12. In addition, the desired level of secondary radiation attenuation of the second layer 12 will vary depending on the amount of secondary radiation emerging from the first layer 12, the sensitivity of the component 18 to such radiation and other factors. Secondary neutron radiation attenuation may be of particular concern where the component 18 is sensitive to nonionizing radiation damage, e.g., where the component 18 comprises a charge-coupled device. In this regard, it has been found that secondary neutrons, and particularly secondary neutrons in the $10^{-2}$ to $10^{0}$ MeV range, can have a deleterious effect on optical devices which are commonly sensitive to nonionizing radiation damage. Thus, the desired level of radiation attenuation of the second layer 16, which can be determined in conjunction with characteristics of the first layer and which depends on application specific considerations, may vary broadly in accordance with the present invention.

Candidate materials for use in constructing the layers 12 and 16 can therefore be selected based on their proton and neutron scattering and absorption properties. For optical component shielding applications, it is desired to attenuate proton and neutron radiation in the $10^{-2}$ MeV to $10^{0}$ MeV energy range and minimize shielding mass. In this regard, the first layer 12 can be constructed from material comprising an element having a relatively low atomic number, preferably below about 14. Such materials generally provide suitable proton attenuation with relatively small thicknesses. The first layer should preferably have a proton stopping efficiency for protons in the $10^{-2}$ MeV to $10^{0}$ MeV range at least equal to that of aluminum. Conveniently, the first layer 12 may be constructed from aluminum which is readily available and commonly used for proton shielding. In this manner, the first layer 12 can be incorporated into the spacecraft 20 design thereby further reducing weight, e.g., a portion of spacecraft wall or skin can be utilized as the first layer 12. However, denser materials such as tantalum may be utilized where the shield is dimensionally constrained. The second layer 16 can be constructed from material comprising an element having an atomic number of about 4–6, i.e., beryllium, boron or carbon. Such materials are believed to be particularly well-suited for neutron radiation attenuation. In particular, boron-nitride has been found to have excellent primary proton and secondary neutron attenuation characteristics. Preferred materials for use in the second layer 16 should have a neutron stopping efficiency at least equal to that of a aluminum.

In addition to the radiation attenuation characteristics described above, the materials used in constructing the layers 12 and 16 may be selected based on other characteristics desired for particular shielding applications. For example, it is anticipated that designers will generally prefer to use materials which are easily machinable, particularly for applications where an irregularly shaped shield is required. In addition, for many space environment applications, materials having low outgassing properties and a low coefficient of thermal expansion are required. Many other properties may be preferred for specific applications.

Figure 2:
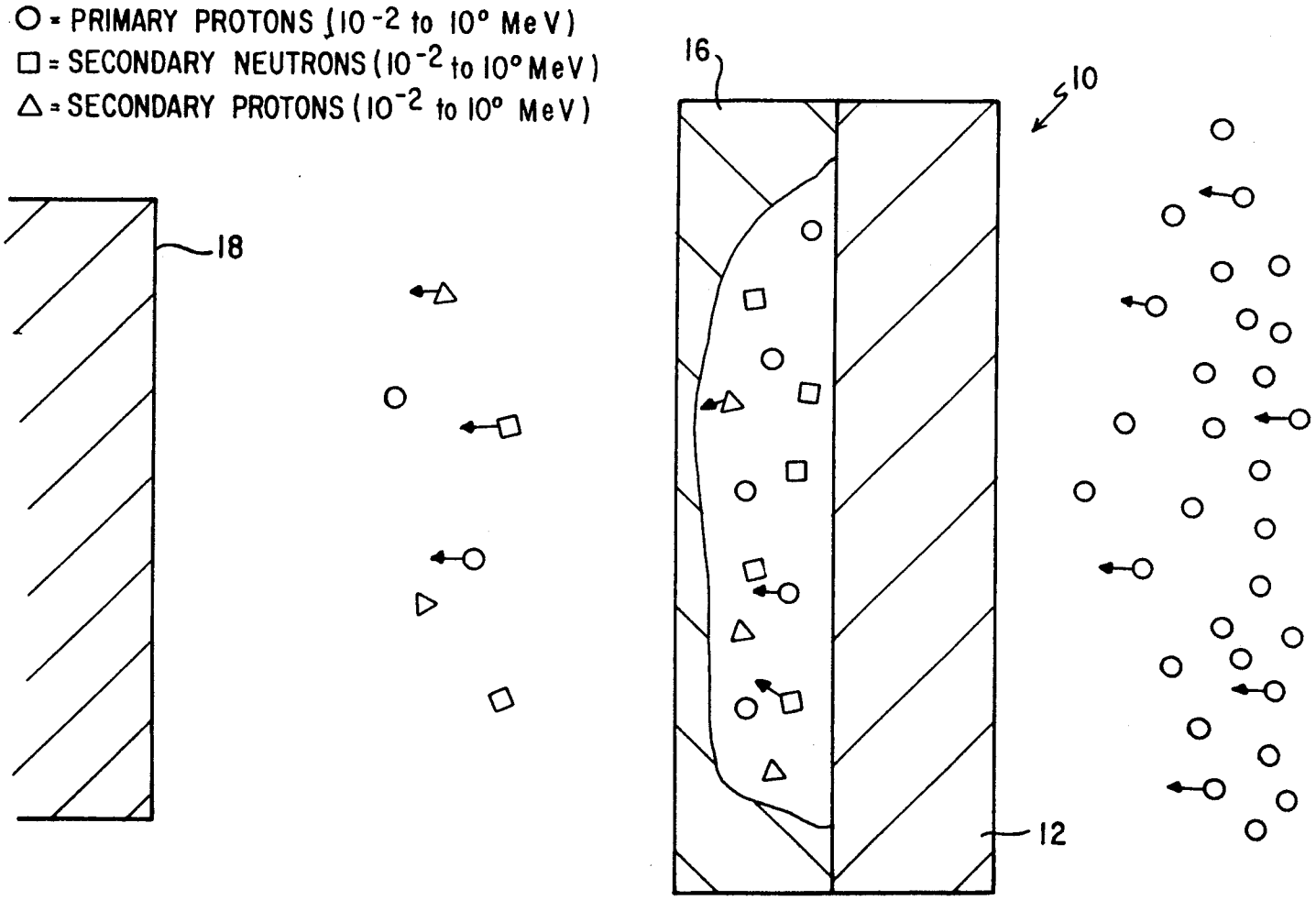
FIG. 2 is a schematic representation, partially cutaway, of the shielding apparatus of FIG. 1.

Referring to FIG. 2, a schematic view, partially cutaway, of the shielding apparatus 10 is shown to symbolically illustrate the operation of the apparatus 10. The circles represent primary protons having energies between about $10^{-2}$ and $10^{0}$ MeV incident on the apparatus 10 due to a solar particle event. As shown in the cut-away, although the first layer 12 attenuates the primary proton radiation, some of the primary protons emerge from the first layer 12. In addition, secondary neutrons (represented by squares) and secondary protons (represented by triangles) having energies between about $10^{-2}$ and $10^{0}$ MeV emerge from the first layer 12 due to interaction of the primary protons with the first layer 12. It will be appreciated that the secondary proton fluence will typically be relatively low in comparison to the primary proton fluence. The second layer 16 further attenuates primary proton radiation and attenuates the secondary proton and neutron radiation so that the overall primary and secondary radiation incident on the component is reduced relative to prior art single layer shields.

Figure 3:
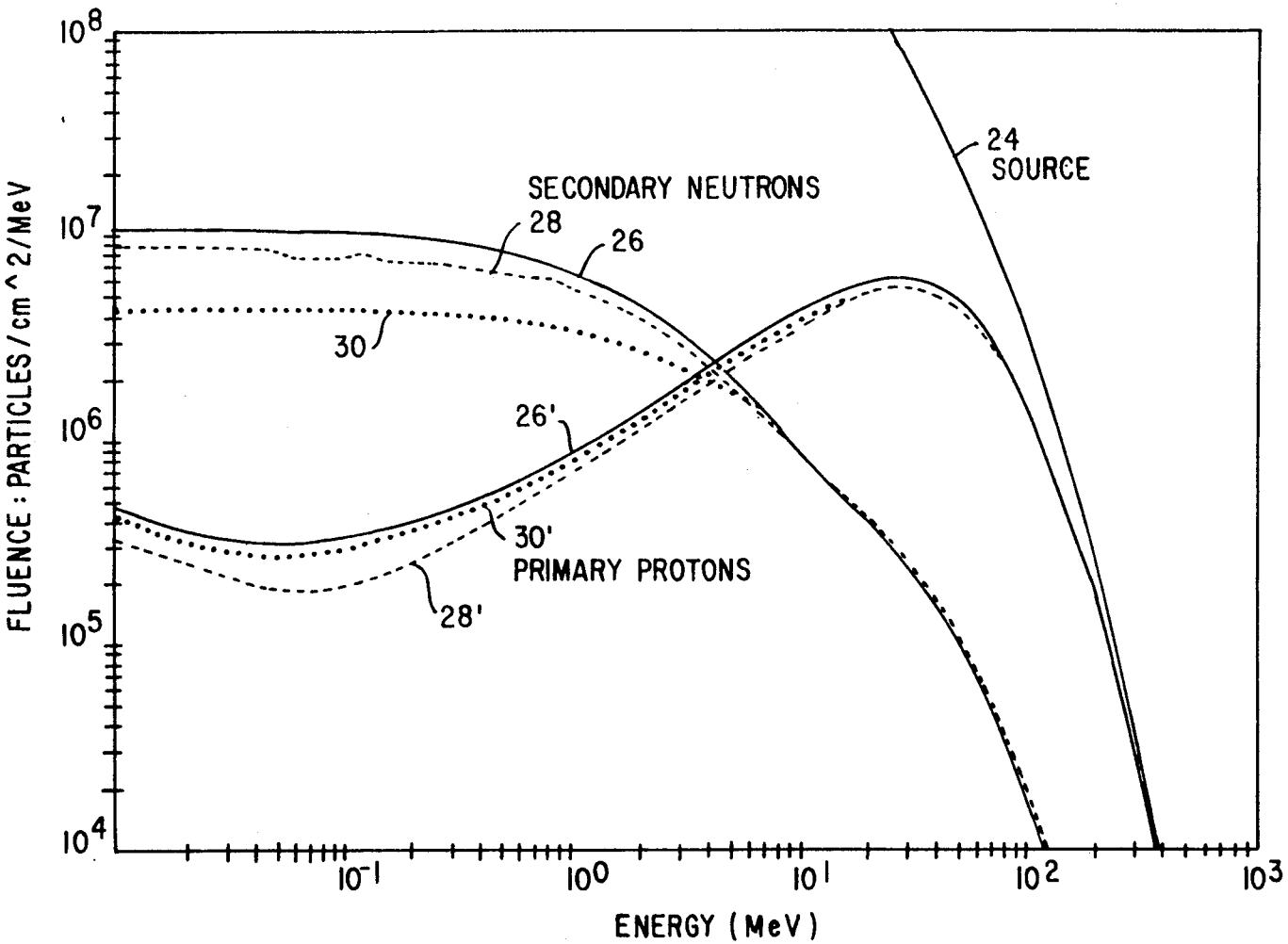
FIG. 3 is a graphical representation of test results for various shields.

Referring to FIG. 3, multi-layer shielding designs in accordance with the present invention were compared to a prior art single layer design using specially adapted BRYNTRN software. The BRYNTRN codes, originally developed by NASA, are documented in NASA Technical Paper 2887, *BRYNTRN: A Baryon Transport Model*, March 1989, which is incorporated herein by reference. These codes, which are based on solutions to the one-dimensional Boltzman transport equation, have been used to analyze the efficacy of single layer shields, particularly aluminum shields, in limiting human exposure to radiation. The BRYNTRN codes have been extended and modified to allow analysis of different shielding materials, multi-layer shields, and different target materials, e.g., silicon has been utilized to simulate an optical component in place of water which has previously been used to simulate human tissue.

FIG. 3 shows the results of analyses performed on three different shields, each having a total shield thickness of 4.0 gm/cm$^2$. It will thus be appreciated that the subject shields have the same shield mass for a given area of shielding. The source spectrum 24 used for the analysis was equivalent to the sum of all solar flare events in 1989 as experienced in an Earth orbit having an altitude of 700 km and an inclination of 98.19°. The solid spectra 26 and 26' represent the emerging secondary neutrons and primary protons, respectively, from a single layer aluminum shield in accordance with the prior art. The dashed spectra 28 and 28' represent the emerging secondary neutrons and primary protons, respectively, emerging from a shield comprising a first layer of 2 gm/cm$^2$ aluminum in front of a second layer of 2 gm/cm$^2$ boron-nitride. The dotted spectra 30 and 30' represent the secondary neutrons and primary protons, respectively, emerging from a shield comprising a first layer of 2 gm/cm$^2$ boron-nitride in front of a second layer of 2 gm/cm$^2$ of aluminum.

The results show that either of the two layer shields provide primary proton and secondary neutron attenuation superior to the commonly used single layer aluminum shield. In addition, comparison of the spectra 28 and 28' to the spectra 30 and 30' also shows that the radiation attenuation characteristics of a layered shield depend not only on the materials and amounts of materials used, but also on the ordering of the layers. That is, the results show that the two layer shield having an aluminum layer in front of a boron-nitride layer provides better primary proton attenuation than does the two layer shield having a boron-nitride layer in front of an aluminum layer, whereas the opposite is true for secondary neutron attenuation. Accordingly, the layer ordering can be selected to provide desired levels of primary proton and/or secondary neutron attenuation for particular applications. Thus, for a given shielding mass, primary and secondary radiation attenuation can be improved through selection of a multi-layer shield with appropriate materials and layer ordering.

Although the present invention has been described with respect to specific embodiments thereof, various changes and modifications may be suggested to one skilled in the art and it is intended that the present invention encompass such changes and modifications as fall within the scope of the appended claims.

What is claimed is:

1. An apparatus for shielding a spacecraft semi-conductor component against space environment proton radiation from a proton radiation source and against secondary neutron radiation having an energy between about $10^{-2}$ and $10^{0}$ MeV resulting from interaction of the proton radiation with portions of the shielding apparatus, comprising:

a first layer constructed from a first proton blocking material, positioned between said source and said semi-conductor component, to attenuate primary proton radiation from said proton radiation source, said first material comprising an element having an atomic number less than about 14, wherein secondary neutron radiation emerges from said first layer due to interaction of said primary proton radiation with said first layer; and a second layer constructed from a second material different than said first material, positioned between said first layer and said semi-conductor component, to attenuate said secondary radiation, said second material having a greater neutron attenuation efficiency for neutrons having an energy between about $10^{-2}$ and $10^{0}$ MeV than said first material.

2. The apparatus as claimed in claim 1, wherein said first material has a greater proton attenuation efficiency for protons having an energy between about $10^{-2}$ and $10^{0}$ MeV than the second material.

3. The apparatus as claimed in claim 1, wherein said first material has a proton attenuation efficiency at least equal to that of aluminum for protons having an energy between about $10^{-2}$ and $10^{0}$ MeV.

4. The apparatus as claimed in claim 1, wherein said first material comprises aluminum.

5. The apparatus as claimed in claim 1, wherein said first material comprises boron nitride.

6. The apparatus as claimed in claim 1, wherein said first layer abuts against said second layer.

7. The apparatus as claimed in claim 1, wherein said first layer comprises a portion of a spacecraft wall.

8. The apparatus as claimed in claim 1, wherein said second material has a neutron stopping efficiency at least equal to that of aluminum for neutrons having an energy between about $10^{-2}$ and $10^{0}$ MeV.

9. The apparatus as claimed in claim 1, wherein said second material comprises an element selected from the group consisting essentially of beryllium, boron and carbon.

10. The apparatus as claimed in claim 1, wherein said second material comprises boron nitride.

11. The apparatus as claimed in claim 1, wherein said second material comprises aluminum.

12. An apparatus for shielding a spacecraft semi-conductor component against proton radiation due to solar particle events and against secondary neutron radiation having an energy between about $10^{-2}$ and $10^{0}$ MeV resulting from interaction of the proton radiation with portions of the shielding apparatus, comprising:

a first, proton blocking layer constructed of a first material and positioned to shield said semi-conductor component against said solar proton radiation, the first layer providing a desired level of proton radiation attenuation, said first material comprising an element having an atomic number less than about 14, wherein secondary neutron radiation is generated due to interaction of said solar proton radiation with the first layer; and a second, proton and neutron blocking layer constructed of a second material and positioned between said first layer and said semi-conductor component to provide a desired level of attenuation for protons and neutrons having an energy between about $10^{-2}$ and $10^{0}$ MeV, said second material comprising an element selected from the group consisting essentially of beryllium, boron and carbon.

13. The apparatus as claimed in claim 12, wherein said first layer comprises aluminum and said second layer comprises boron nitride.

* * * * *